US006305725B1

(12) United States Patent
Antonucci et al.

(10) Patent No.: US 6,305,725 B1
(45) Date of Patent: Oct. 23, 2001

(54) ONE-PIECE SLAM-ACTION PAWL LATCH

(75) Inventors: Jeffrey L. Antonucci, Worcester (GB); J. Thomas Weuthen, Erkelenz (DE)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/434,791

(22) Filed: Nov. 5, 1999

Related U.S. Application Data

(63) Continuation-in-part of application No. 09/260,638, filed on Mar. 2, 1999, which is a continuation-in-part of application No. 09/187,120, filed on Nov. 5, 1998.

(51) Int. Cl.[7] ..... E05C 5/00

(52) U.S. Cl. ..... 292/67; 292/128; 292/114; 292/203; 292/DIG. 53; 292/DIG. 61

(58) Field of Search ..... 292/13, 57, 67, 292/60, 61, 63, 71, 80, 89, 109, 114, 128, 175, 203, 207, 209, 228, DIG. 53, DIG. 61; D8/331; 411/549, 552, 508, 509, 913

(56) References Cited

U.S. PATENT DOCUMENTS

| | | | | |
|---|---|---|---|---|
| Re. 24,426 | | 2/1958 | Quinn . | |
| 147,137 | * | 2/1874 | Jones . | |
| D. 180,260 | | 5/1957 | Adams et al. . | |
| D. 324,636 | | 3/1992 | Schlack et al. | D8/331 |
| D. 357,396 | | 4/1995 | Ziemer et al. | D8/330 |
| D. 370,620 | | 6/1996 | Ziemer | D8/330 |
| 471,363 | | 3/1892 | Sloan, Jr. . | |
| 743,716 | | 11/1903 | Hadka . | |
| 1,071,999 | | 9/1913 | Gilson . | |
| 2,169,535 | | 8/1939 | Marple . | |
| 4,153,284 | | 5/1979 | Wright . | |
| 5,358,291 | | 10/1994 | Manmanger et al. | 292/175 |
| 5,603,535 | | 2/1997 | Antonucci et al. | 292/128 |

* cited by examiner

*Primary Examiner*—Gary Estremsky
(74) *Attorney, Agent, or Firm*—Paul & Paul

(57) ABSTRACT

A pawl latch having slam-action latching and rotational unlatching actuation is mounted in an aperture formed in a closure panel for releasably retaining the closure panel against a corresponding frame, the pawl latch including a one-piece body with a pawl, a gripping portion, mounting elements, and a spring member, the spring member having a first end and a second end, the first end being connected to the latch body and the second end being held by the closure panel to provide a biasing force to return the pawl to its active position where it is aligned with a keeper member provided on the corresponding frame for slam action latching of the latch.

27 Claims, 17 Drawing Sheets

ONE-PIECE SLAM-ACTION PAWL LATCH

CROSS-REFERENCE TO RELATED APPLICATIONS

This application is a continuation-in-part of U.S. Application Ser. No. 09/260,638 filed on Mar. 2, 1999, which is a continuation-in-part of U.S. Application Ser. No. 09/187,120 filed on Nov. 5, 1998. A foreign filing license, No. 523,932 was granted on Nov. 3, 1999 for the contents of this application, according a provisional serial No. P-101,411.

BACKGROUND OF THE INVENTION

1. Field of the Invention

The present invention relates generally to latching devices and more particularly to latches which are operable through slam-action closing and rotational opening to secure a first member, such as a door or panel, in a closed position relative to a second member, such as a frame or cabinet.

2. Background of the Invention

Presently, there are a number of pawl assemblies known in the art which are operable by rotation of a shaft or the like for securing panels together or against a corresponding frame. Generally, fasteners of this type include a latching pawl which is provided extending from a shaft disposed in a latch housing. In operation, rotation of the shaft corresponds with a movement of the latching pawl to its latched position. Generally, the fasteners of this type require varying degrees of rotation of the shaft for operation of the latch. These latches include one or more fixed members, such as a housing, which is mounted to a panel, and also include movable members which are rotatably provided to turn relative to a fixed member.

One type of latch is a "quarter turn" fastener which requires a 90° rotation for operation. Such latches usually consist of a housing, drive stud, spring and pawl which are installed within an aperture formed in a door panel. However, one problem with such prior art designs is that water, dust and other matter is able to pass freely through the latch and into the interior compartment of the door panel, thus into contact with the contents contained therein. Another problem is that the spring which is positioned proximate the top of the latch between the drive stud and the housing is required during operation to support the load which is being applied by the latch. This increased stress applied by the latch adversely affects the spring's operation and durability.

Furthermore, the designs which have been developed in order to hasten the installation process have proven to adversely affect latch operation. In particular, some designs allow a mounting nut to be slid over the pawl and onto the housing in order to accommodate installation within a panel aperture. However, these prior art designs require either a necked down section in the pawl, which reduces the strength of the pawl, or an extra loop in the pawl, which is rather difficult to manufacture. These prior art latches generally include several components which must be assembled and installed on a panel. In some cases, prior art type latches include components which must be installed on the panel, and then other components which must be installed on the panel mounted components. The need exists for a latch which can be resistant to debris and dust, and can be readily installed on a panel for operation.

A rotating pawl latch, where a pawl is rotated to one location to close the latch and to another location for releasing the latch are known. However, with such a prior art device, slam latching is not provided, rather, the pawl must be returned to its original position by further rotation by the user. In instances, such as the examples referred to above, multiple components are required to regulate the movement of the pawl among latching and releasing positions. In industries, such as, automotive assembly operations, the ease with which latch installation can be accomplished is important. For example, hinged panel, as well as lift-off panel applications are common uses in the automotive industry where slam latches are employed. The panels to be latched, for example, can include closure panels of storage compartments, as well as mechanical panels to regulate access to engines, and other mechanical systems.

In addition, many latches require precise alignment so that a pawl can engage a keeper and maintain the latch against being inadvertently opened or unsecured. For example, in conditions where wear and tear on adjacent panel members creates gaps or misalignment between the panels, often a keeper must be reinstalled for proper positioning or the panel replaced. Furthermore, where temperature changes occur, such as extreme hot and cold due to sunlight exposure, or changes in environmental temperatures, panels may tend to misalign. Furthermore, a panel may bear the load from a weight or object upon it and can buckle or bend, also affecting the panel alignment. A need therefore exists, for a latch which can be installed in a panel and can facilitate maintaining the latch in a secured relation with a keeper over a range of positions, for example if a panel becomes misaligned.

The present invention attempts to provide a latch which is an improvement over prior latch designs, and which provides features of slam action and spring return of the pawl member, and, further, which can be readily mounted to a panel.

SUMMARY OF THE INVENTION

The present invention provides a slam action pawl latch which is adapted to be mounted to a first member, such as, for example, a closure panel for releasably retaining the closure panel against a second member, such as, for example, a corresponding frame. The pawl latch of the present invention includes a one-piece body with mounting elements which are adapted for being received within the closure panel aperture to maintain the latch therein. The latch body also includes a pawl member which extends outwardly therefrom to engage a keeper member of the frame and secure the closure panel. A spring member is also provided to bias the latch to return to its original position so that slam actuation can occur, again, after the latch has been rotated to release the pawl from the keeper. The latch includes mounting elements and can be snap-fit into a panel aperture for installation. Preferably, the closure panel to which the latch is installed is provided with a holding element for maintaining an end of the spring member when the latch is rotated to release the pawl from engagement with a keeper.

A latch bezel element can be provided to facilitate mounting of the latch to a panel which has a coarse or uneven surface such as, for example, a carpeted panel. The bezel element has an aperture therein in which the latch is mounted and has a surface portion on which the latch rotates. The bezel element is mounted to a closure panel.

An object of the present invention is to provide a pawl latch which can be readily installed to a panel by insertion into a panel aperture.

A further object of the present invention is to provide a pawl latch which is durable in use and yet provides a smooth latching operation.

Another object of the present invention to provide a pawl latch which is provided having one-piece construction.

Another object of the present invention is to provide a pawl latch which can be slammed shut to secure the pawl to a keeper, and rotated to release the pawl from the keeper.

Another object of the present invention is to provide a pawl latch which includes a biasing component for returning the pawl to its original position for subsequent slam-latching after the latch has been rotated to release the pawl.

Another object of the present invention is to provide a pawl latch having a one-piece construction wherein the entire latch is rotated to release the pawl from engagement with a keeper member and where a spring element provided integral with the latch body operates to return the latch to its original position after release of the latch.

Another object of the present invention is to provide a pawl latch which can be used for securing one or more panels together, including lift-off panels, sliding panels, hinged panels, and to secure panels to a compartment frame or other surface.

Another object of the present invention is to provide a pawl latch which can be used for securing one or more panels together, including a closure panel to a corresponding frame, which permits latching over a range of positions relative to the alignment of the closure panel and corresponding frame.

Another object of the present invention is to provide a pawl latch which can be selectively rotated to release a pawl from a keeper which has elements for facilitating the rotation of the latch relative to a panel to which it is installed.

It is another object of the present invention to accomplish the above object by providing a bezel element which mounts on a closure panel, and which facilitates installation of the latch.

These and other objects of the present invention will become more readily apparent when taken into consideration with the following description and the attached drawings.

DETAILED DESCRIPTION OF THE PREFERRED EMBODIMENTS

Figure 2:
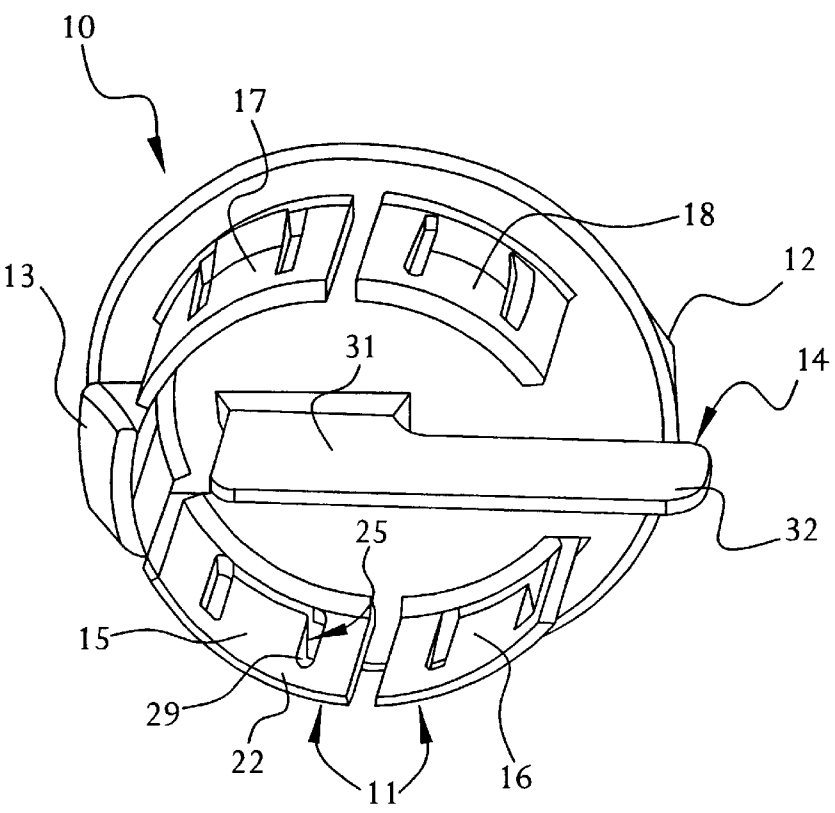
FIG. 2 is a parallel perspective view of the pawl latch shown in FIG. 1, viewed from the bottom left side.
Figure 1:
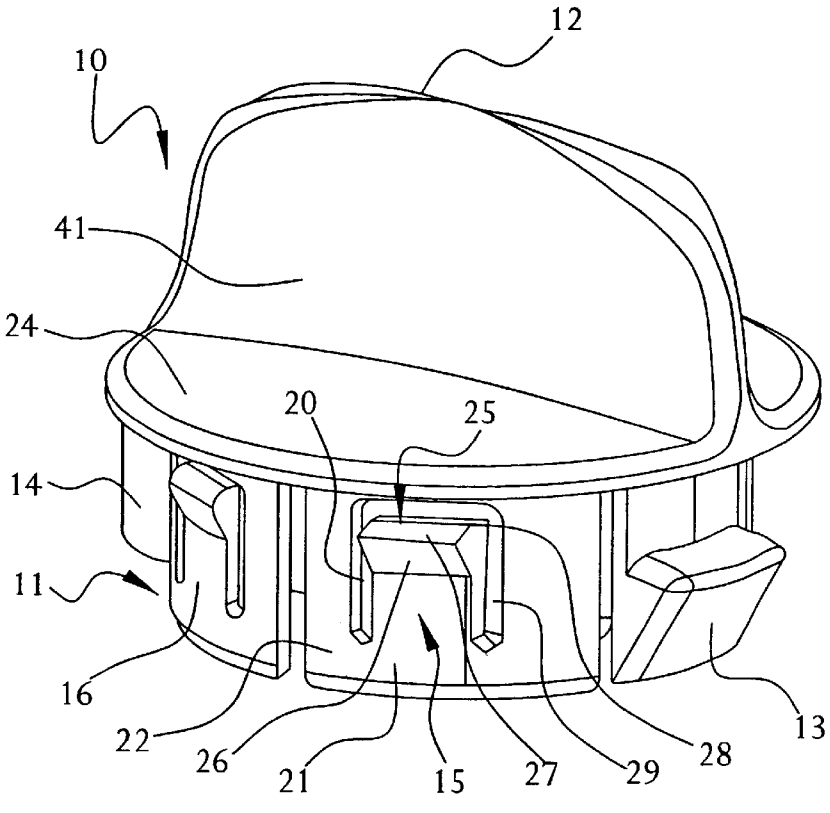
FIG. 1 a parallel perspective elevation view of a pawl latch according to the present invention viewed from the top right side.

Referring now to the drawings figures, there is shown in FIG. 1, a pawl latch 10 according to the present invention, comprising a latch body 11, a gripping portion 12, a pawl member 13 and biasing means for biasing the latch, the biasing means comprising a spring member 14. Mounting means is provided for mounting the latch 10 to a first member, such as the closure panel 100 shown in FIGS. 6–9. The mounting means preferably can comprise retaining elements, such as, for example, the snap legs 15, 16, 17, and 18 disposed about the circumference of the latch body 11. Preferably, as shown, the snap legs 15, 16, 17 and 18 include a free portion 20 and an attached portion 21. The attached portion 21 is shown connected to a circumferential wall portion 22 extending downwardly from the base 24 of the gripping portion 12. The free portion 20 of the leg member 15 includes a foot 25 which has a sloped lower wall 26 and a sloped upper wall 27, with a shelf or flat wall 28. The additional snap legs 16, 17 and 18 are shown in FIG. 2 having a configuration identical to that leg 15, described herein. A groove or cut-out portion 29 formed in the circumferential wall portion 22 surrounds the snap leg 15 as shown in FIG. 1. While the circumferential wall portion 22 is shown with a series of wall portions disposed about the circumference of the latch 10, it will be understood that greater or lesser numbers of wall portions can be provided. For example, the circumferential wall portion can comprise a single wall portion with cutouts for the spring and pawl members.

The pawl member 13 is flexibly provided and is shown having an attached end connected to the latch body and a free end which is provided to engage a keeper member, such as that 201 provided on the frame 200 (FIGS. 6–9). Although shown configured as a ledge with a sloped wall, the pawl member 13, can alternately comprise other configurations which are suitable for connecting with a keeper member.

Figure 3:
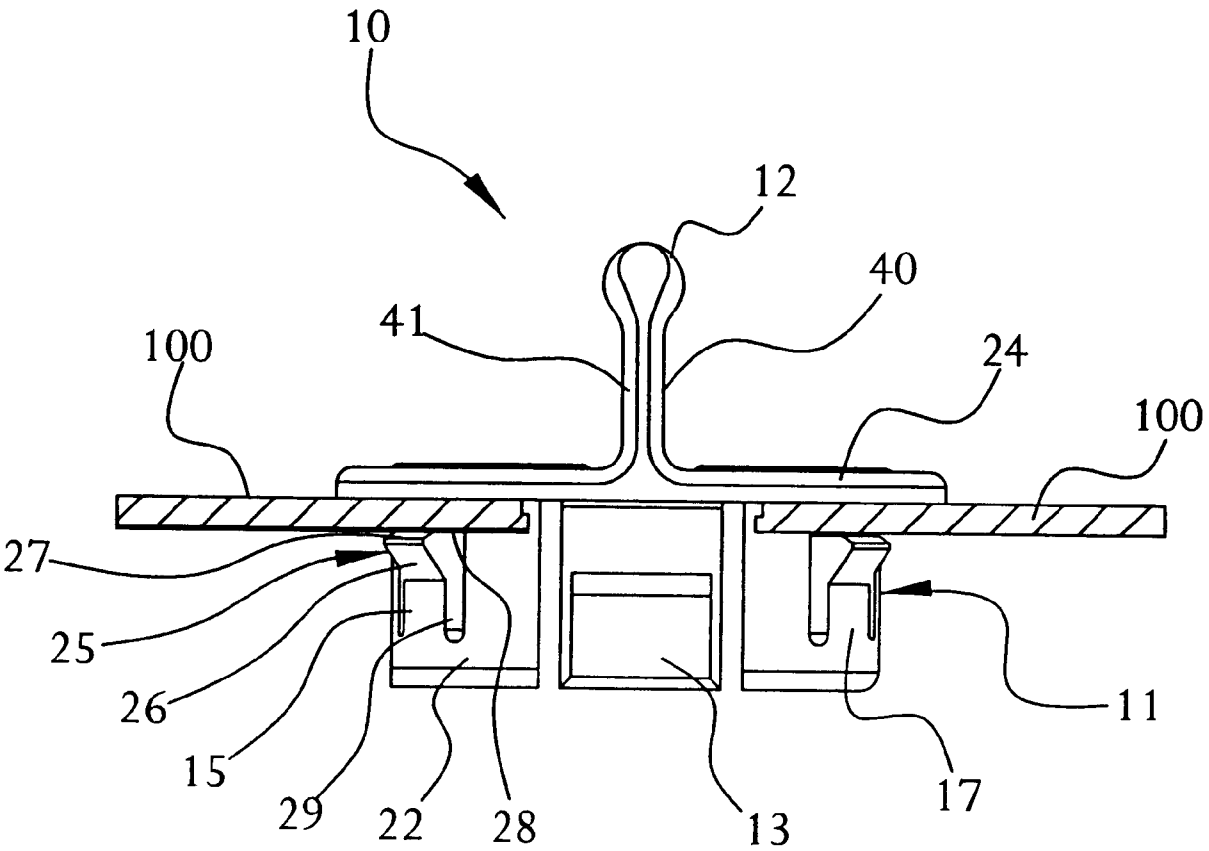
FIG. 3 is a front elevation view of the pawl latch of FIG. 1 shown installed on a closure panel e closure panel being shown in a partial sectional, cut-away view.
Figure 6:
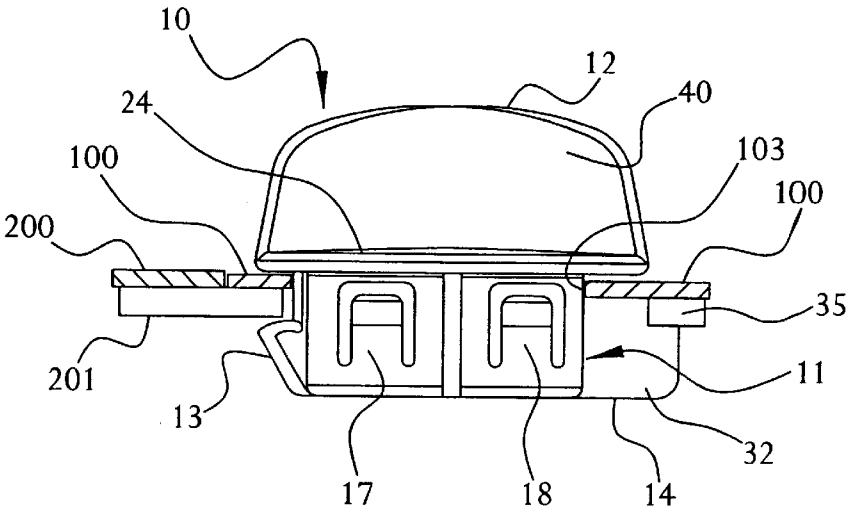
FIG. 6 is a left side elevation view showing the pawl latch installed in a closure panel which is shown with a corresponding frame, wherein the pawl member is secured to a keeper member provided on the frame.
Figure 7:
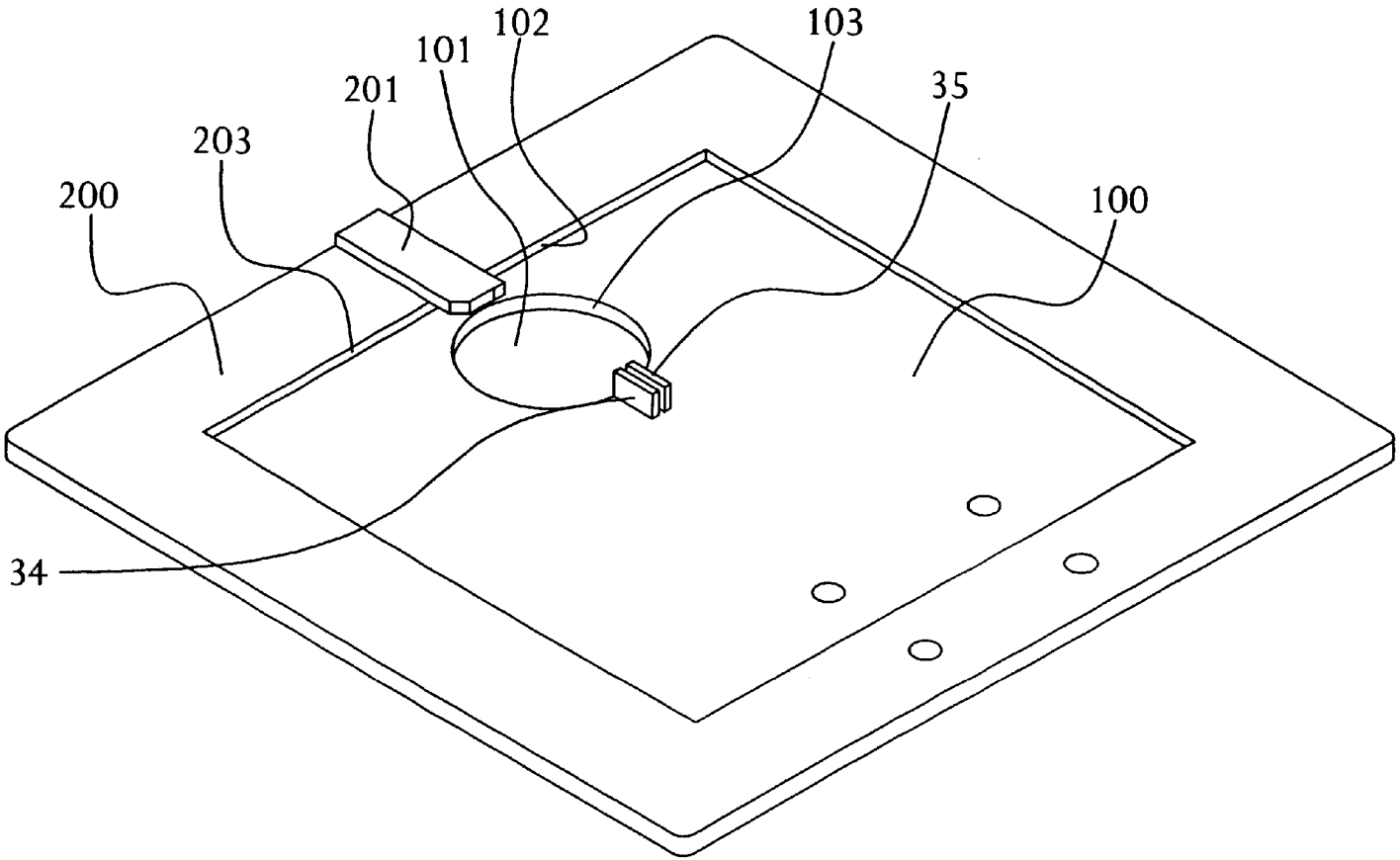
FIG. 7 is a bottom parallel perspective view showing a closure panel attached to a frame, with a keeper member provided on the frame.
Figure 9:
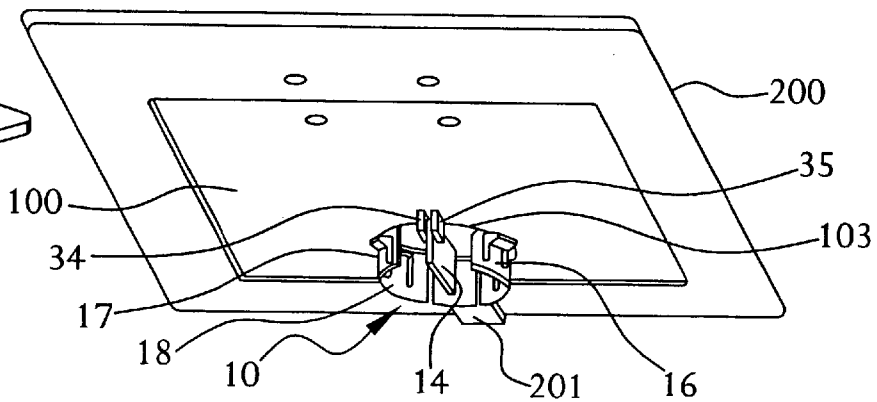
FIG. 9 is a parallel perspective view of the pawl latch and the installation shown in FIG. 8, as viewed from the bottom.
Figure 8:
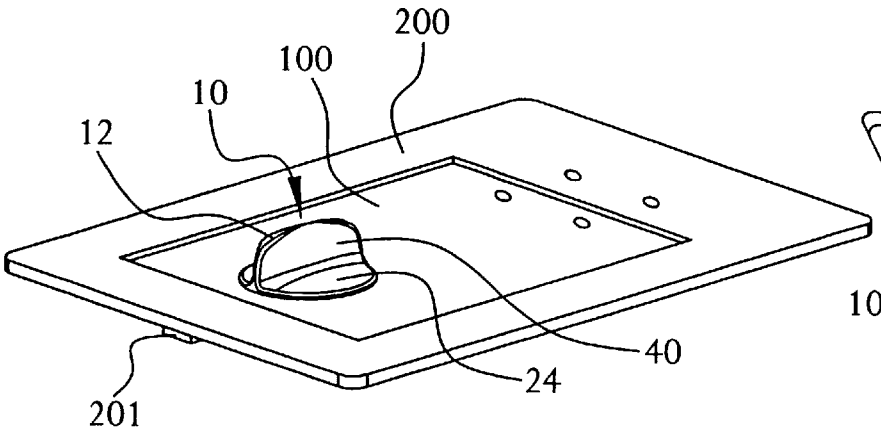
FIG. 8 is a parallel perspective view of the pawl latch, as viewed from above, shown installed on a closure panel which is secured to a corresponding frame.

Referring now to FIG. 3, the latch 10 is installed on a closure panel 100. The snap legs 15 and 17 clamp the closure panel 100 between the shelf wall 28 of the leg member 15 and the underside of the base 24 of the gripping portion 12. The latch 10 is rotatable within the panel aperture 101 (FIG. 7).

Figure 4:
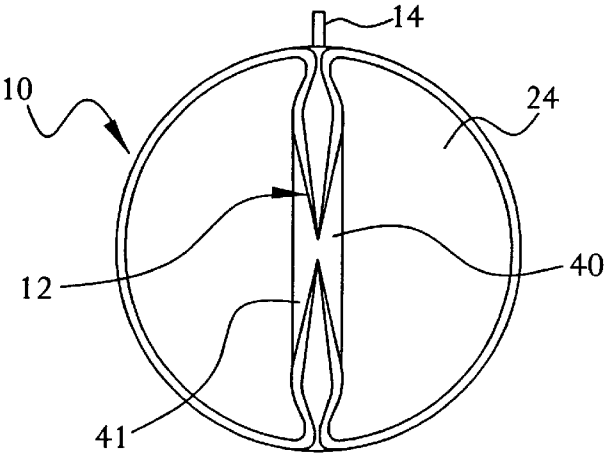
FIG. 4 is a top plan view of the pawl latch of FIG. 1 shown installed in a closure panel.

Referring again to FIG. 2, the spring member 14 is shown having a connecting end 31 which is connected to the base 24 of the gripping portion 12 and having a free end portion 32. As shown best in FIGS. 6 and 9, the free end 32 of the spring member 14 is held with bosses 34, 35 provided on the closure panel 100. The free end 32 remains held within the bosses 34, 35 when the latch 10 is rotated. The spring member 14 biases the latch 10 back to its relaxed position—the position shown in FIG. 4—after the latch 10 with the pawl 13 has been rotated. This permits releasing of the latch 10 by rotating the latch 10 to move the pawl member 13 out of alignment with the keeper 201 so that the closure panel 100 can be opened. The spring member 14 biases the latch 10 to return the pawl member 13 to its aligned position for further latching.

Figure 5:
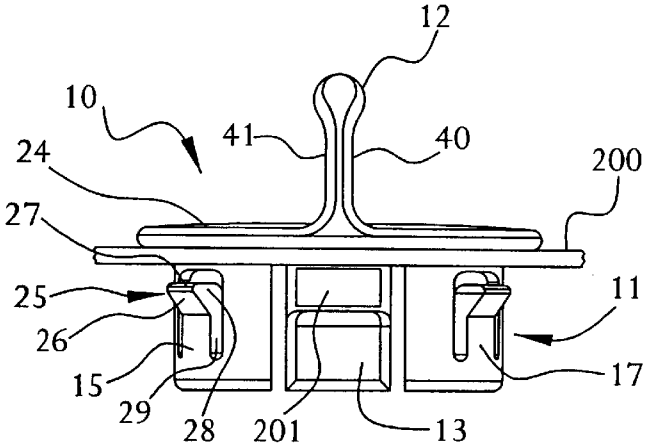
FIG. 5 a front elevation view of the pawl latch of FIG. 1, shown installed on a closure panel with a corresponding frame having a keeper member thereon.

Stop means is preferably provided to stop the closure panel 100 from proceeding past the frame 200 when the closure panel is pivoted for closing. Keeper means is also provided to secure the pawl member 13 of the latch 10. Preferably, the stop means and the keeper means comprise a protruding member 201 provided on the second panel member, such as the frame 200, shown in FIGS. 6 through 9. The protruding member 201, as best viewed in the bottom view of FIG. 7, showing the closure panel 100 and frame 200, preferably extends beyond the edge 203 of the frame 200. The protruding member 201 also, therefore, extends beyond the forward edge 102 of the closure panel 100. The circumferential edge 103 disposed in the closure panel 100 defines the panel aperture 101. Referring to FIG. 5, the pawl member 13 is shown engaging the protruding member 201. Although not shown, it will be understood that the closure panel 100 can be attached to the frame 200 with hinges or any other suitable attachment means, preferably one which permits relative pivoting of the closure panel 100 and frame 200.

The gripping portion 12 of the latch 10 preferably comprises an indented region for facilitating gripping contact by a user's fingers. As shown best in FIGS. 1 and 4, the gripping portion 12 of the latch 10 has a pair of indented side walls 40, 41 which taper toward the center of the latch 10 to comprise the grip facilitating means.

Figure 12:
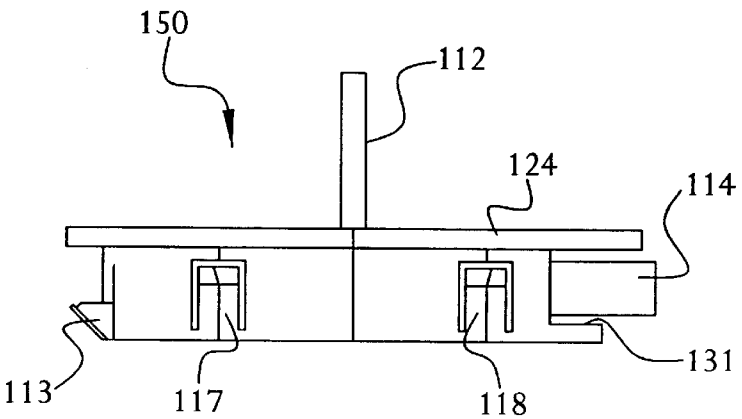
FIG. 12 is a left side elevation view of the pawl latch shown in FIGS. 10 and 11.
Figure 10:
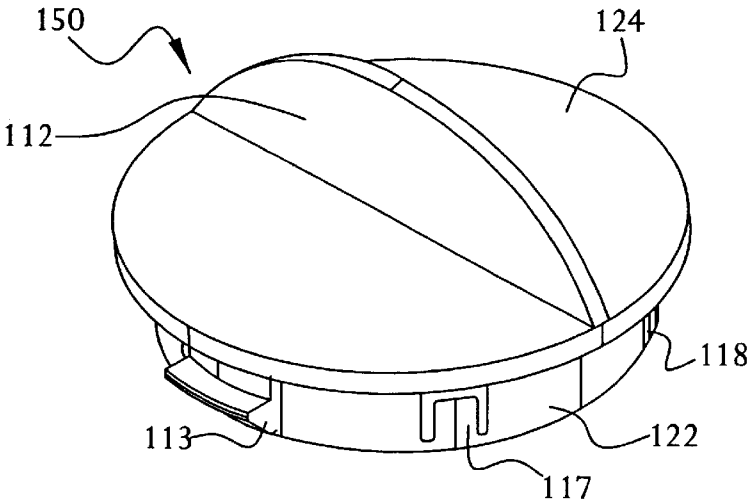
FIG. 10 is a parallel perspective view of a second alternate embodiment of a pawl latch according to the present invention.
Figure 11:
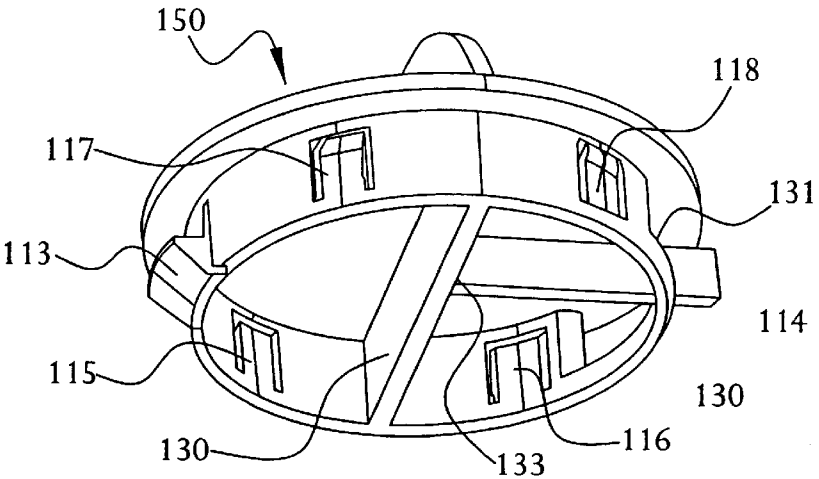
FIG. 11 is a parallel perspective view of the pawl latch shown in FIG. 10, viewed from the bottom left side.

Referring now to FIGS. 10–12, a second alternate embodiment of a pawl latch 150 according to the present invention is shown. The pawl latch 150 is similar to the latch 10 described and shown above in relation with FIGS. 1–9, and is provided to function in the same manner. The pawl latch 150 includes a gripping portion 112 which has a base 124. A cylindrical wall portion 122 is shown extending from the base 124. A plurality of snap leg members 115, 116, 117, 118 are provided to facilitate mounting of the latch 150 to a panel aperture, such as that 101, shown in FIG. 7. A connecting wall portion 130 spans the diameter of the cylindrical wall portion 122 (FIGS. 11 and 12). A spring leg 114 is connected to the connecting wall 130 at one spring leg end with the other spring leg end extending beyond the cylindrical wall 122 for holding within the panel bosses 34, 35 (shown in FIG. 7). The cylindrical wall portion 122 includes a cut-out area 131 through which the spring leg 114 extends. The cut-out area 131 is provided to permit the latch 150 to pivot as the spring leg 114 is held by the bosses 34, 35 located on the closure panel 100.

Other modifications to the above description can be made consistent with the spirit and scope of the invention disclosed herein. For example, while not shown, the free end 32 of the spring member 14 can be provided with an aperture for connection to a pin or other member provided on the closure panel 100. Gaskets can further be provided to seal the latch 10 relative to the closure panel aperture 101 to further facilitate sealing the assembly from dust, dirt and other debris. The keeper 201 while shown and described as a separate member, can be provided as part of the frame 200, or can further comprise a retractable member in the event that the closure panel 100 is to fold past the frame 200. In addition, while the closure panel 100 is shown as a hinged panel in relation to a frame 200, it will be understood that the present latch can be employed in conjunction with other panels and closure members, including, for example, lift-off panels, sliding panels, joining panels, folding panels, and the like.

Figure 13:
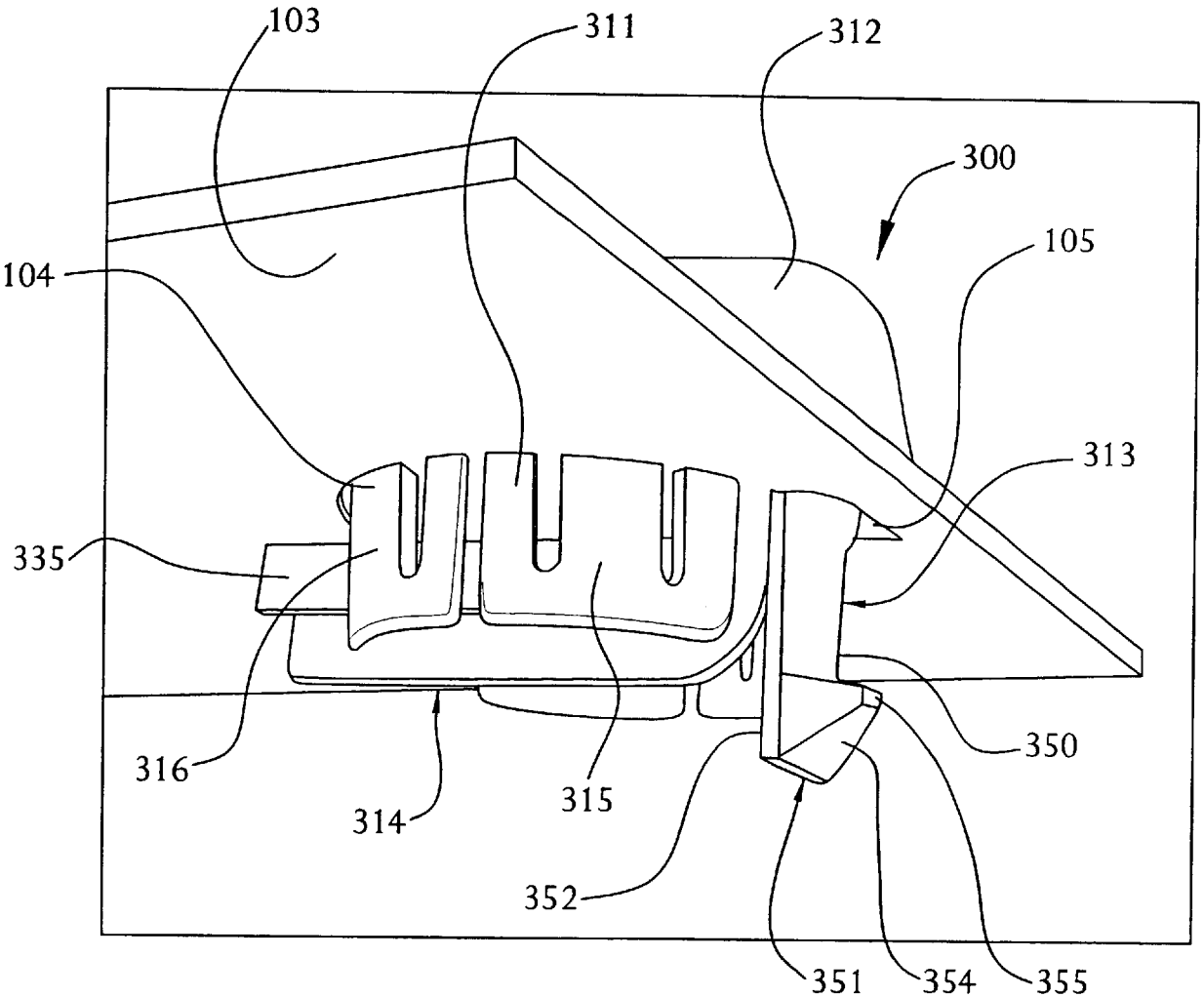
FIG. 13 is a parallel perspective view of a third alternate embodiment of a pawl latch according to the present invention, as viewed from the right side looking at the bottom of the latch, shown installed on a closure panel.
Figure 14:
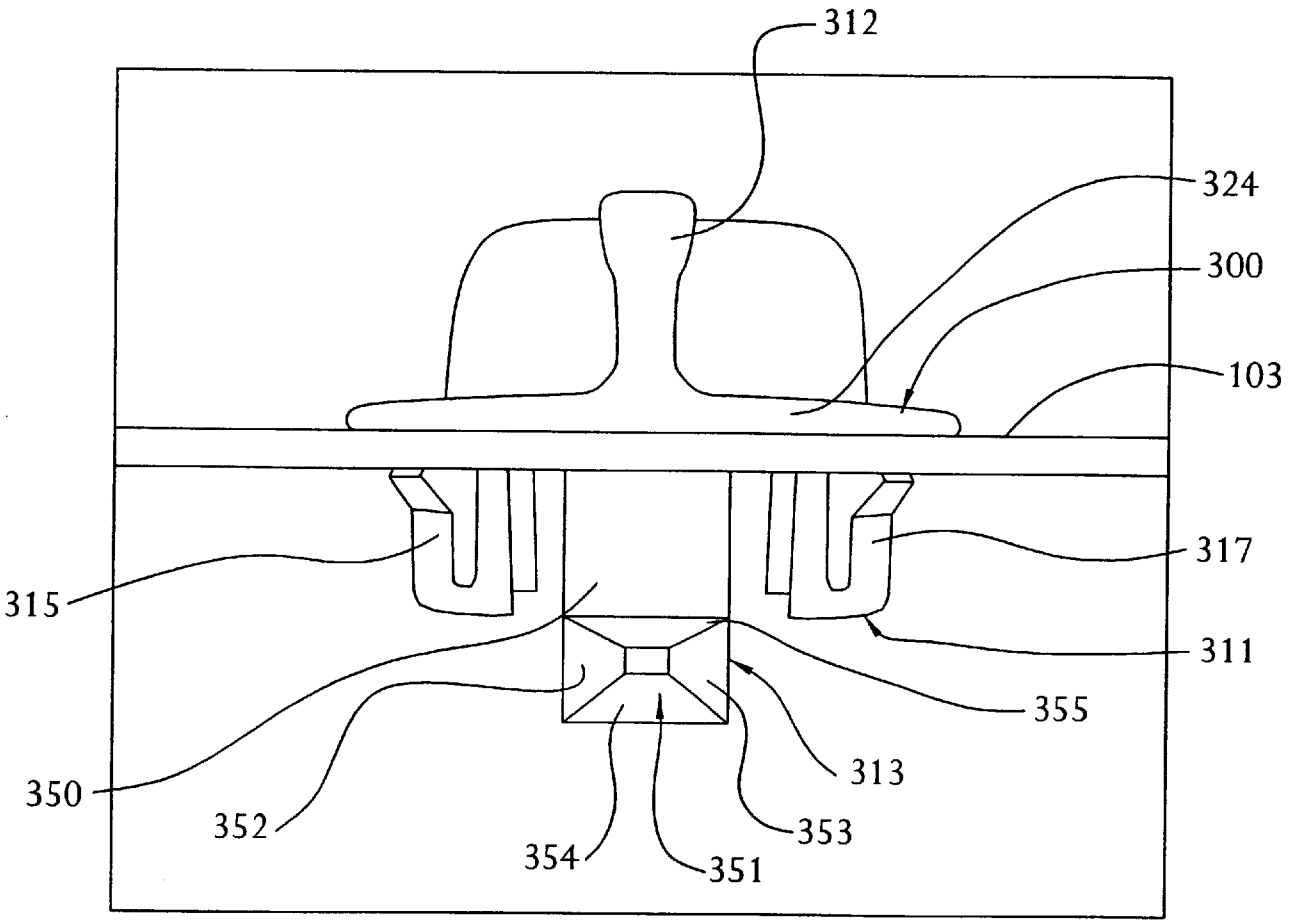
FIG. 14 is a front elevation view of the third alternate embodiment of the pawl latch of the present invention, shown in FIG. 13.

Referring to FIG. 13, a third alternate embodiment of the a pawl latch 300 according to the present invention is shown comprising a latch body 311, a gripping portion 312, a pawl member 313, and biasing means for biasing the latch 300, the biasing means is shown comprising a spring member 314. Mounting means is provided for mounting the latch 300 to a first member, such as the closure panel 103. Preferably, the closure panel 103 includes a cut-out or aperture 104 for accommodating the latch 300 therein. The aperture 104 may also include a notched portion 105 to permit insertion of the pawl 313 through the panel 103 during installation. The mounting means, for example, can comprise retaining elements such as those described above in connection with the latch embodiments of FIGS. 1 though 12, as shown and described herein. For example, snap legs such as, for example those 315, 316 and those 317, 318 (FIGS. 16 and 17), are provided to retain the latch 300 on the panel 103 by engaging the panel surface as shown. The snap legs 315, 316, 317,318, preferably, can comprise spring leg members, as shown and described above in connection with the snap legs 15,16, 17 and 18, of the latch embodiment shown in FIGS. 1 through 9.

Figure 16:
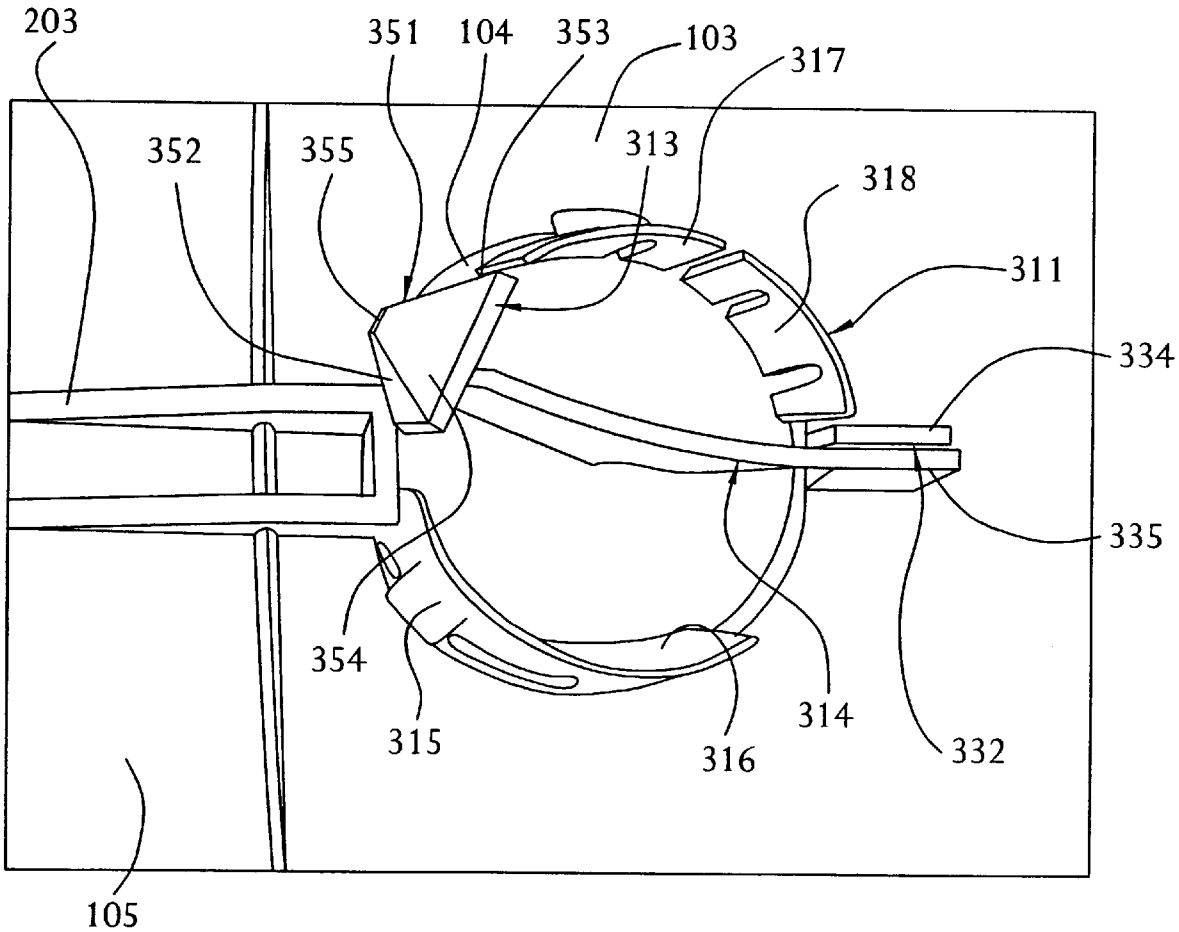
FIG. 16 is a bottom perspective view of the pawl latch shown in FIGS. 13–15, with the latch being rotated showing the pawl disengaged from the keeper, with the latch installed on a closure panel and a keeper installed on a second panel.
Figure 17:
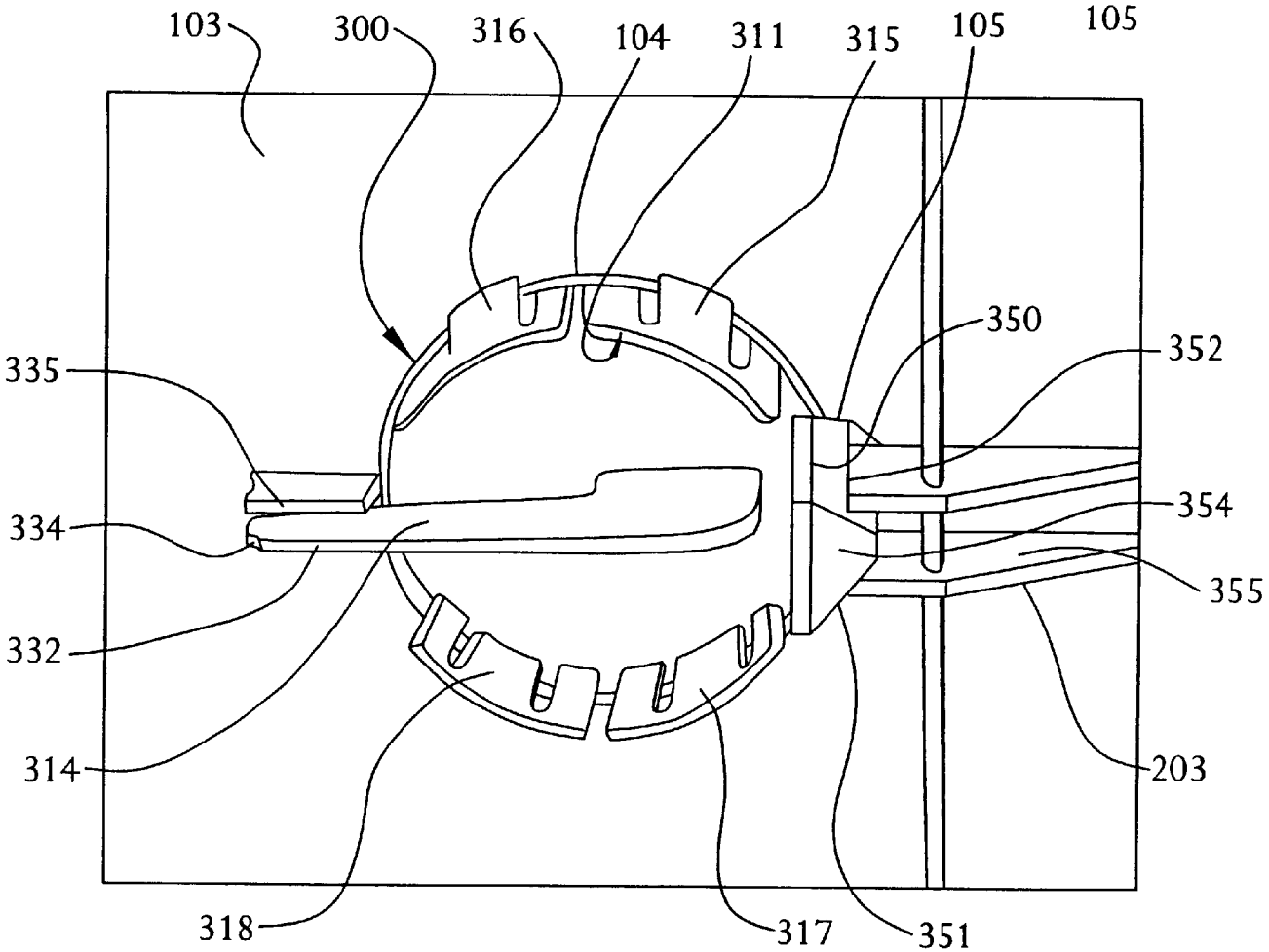
FIG. 17 is a parallel perspective view of the bottom of the pawl latch show in FIG. 16, with the latch n a closed position with the pawl in engagement with a keeper.

As shown best in FIG. 16, the spring member 314 has a free end or leg 332, which remains secured with a pair of bosses 334, 335, provided on the closure panel 103. While bosses 334, 335 are shown, it will be understood that alternate means for securing the end 332 of the spring member 314, can be employed consistent with the scope and spirit of the present invention as described herein. As shown in FIGS. 16 and 17, a second member, such as the compartment frame or second panel 105, is provided with keeper means thereon for selectively securing the pawl 313 and permitting latching of the latch 300 to secure the first and second members 103, 105, respectively, together. The keeper means preferably comprises a keeper member 203, which extends from the second panel member 105 beyond the edge thereof and below the closure panel 103 to which the latch 300 is installed.

Figure 15:
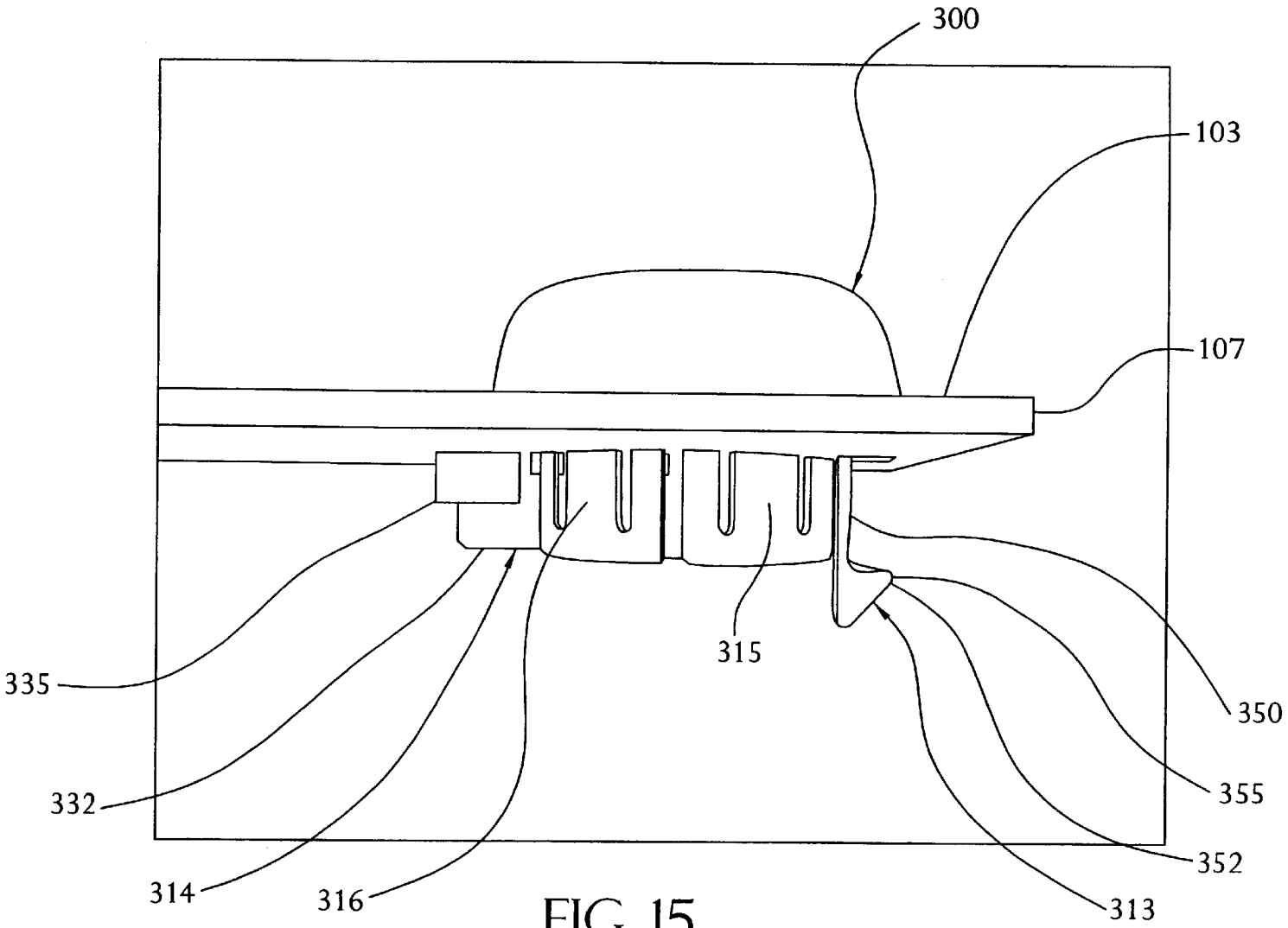
FIG. 15 is a right side elevation view showing the pawl latch of FIGS. 13 and 14.

Referring once again to FIG. 13, the pawl member 313 of the latch 300 has a leg 350 extending downwardly from the base 324 of the gripping portion 312. The pawl leg 350 is preferably a spring leg member, which has a head 351 at the lower end thereof. The head 351 includes a pair of tapered sidewall portions 352, 353 and a tapered lower wall portion 354 which joins with the tapered sidewall portions 352, 353 along an edge thereof. The tapered wall portions 352, 353, 354, comprise facets which join to form a peak 355 which, as shown best in FIG. 15, protrudes forward in relation to the leading edge 107 of the closure panel 103. The configuration of the pawl head 351 facilitates unlatching by permitting the closure panel 103 to release from the second panel 105. Release of the pawl 313 from the keeper 203 is also facilitated, as upon rotation of the latch 300 to a position (FIG. 16) where the head 351 of the pawl 313 clears the keeper 203. The pawl head 351, as shown in FIG. 17, also facilitates retention of the latch 300 when it is secured to a keeper 203. The pawl member 313, is deflected rearwardly upon engagement with a keeper member, such as that 203, provided on the second panel 105 when the closure panel 103 is closed. The pawl head 351 then clears the keeper 203 when the panel 103 is fully closed (to align with a second panel or frame, such as that 105) and the pawl 313 returns to its original position (FIGS. 13 and 17). To open the latch 300, the handle 312 is turned to rotate the pawl 313 with the latch body 31 1 against the bias of the spring member 314, whose leg 332 remains secured in position on the panel 103. When the pawl head 351 clears the keeper 203, the closure panel 103 can then be lifted with the latch 300 installed thereon.

Figure 18:
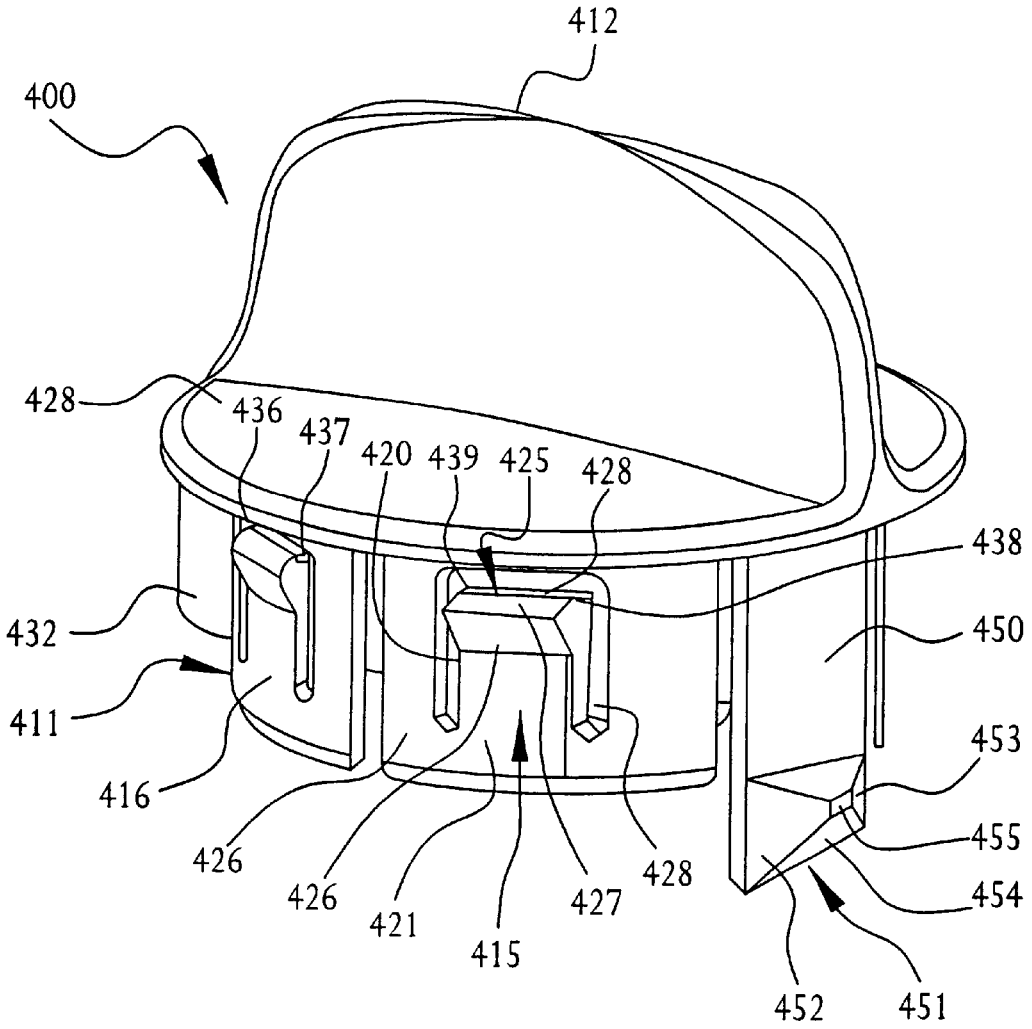
FIG. 18 is a fourth alternate embodiment of a pawl latch according to the present invention, wherein the snap legs are provided having an alternate configuration.
Figure 19:
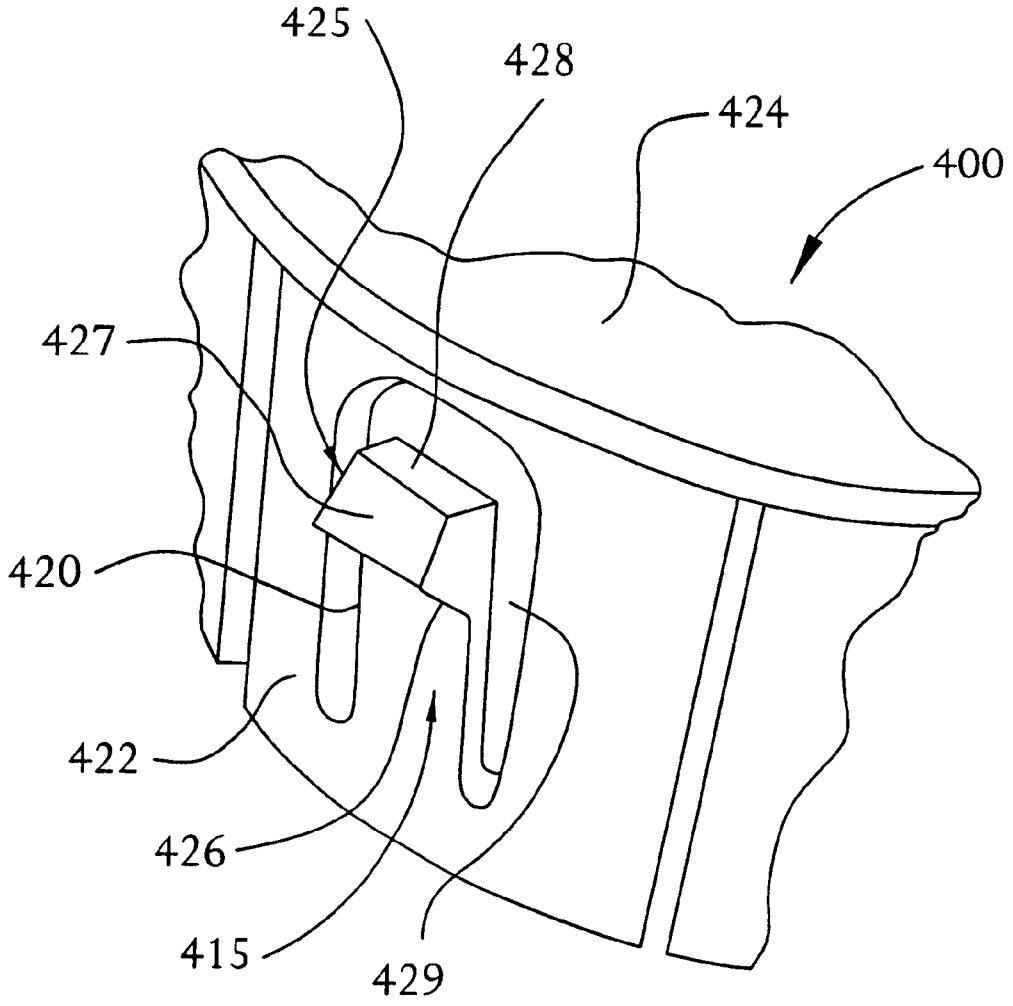
FIG. 19 is a parallel perspective view of a snap leg of the pawl latch shown in FIG. 18, as viewed from the top right side.
Figure 20:
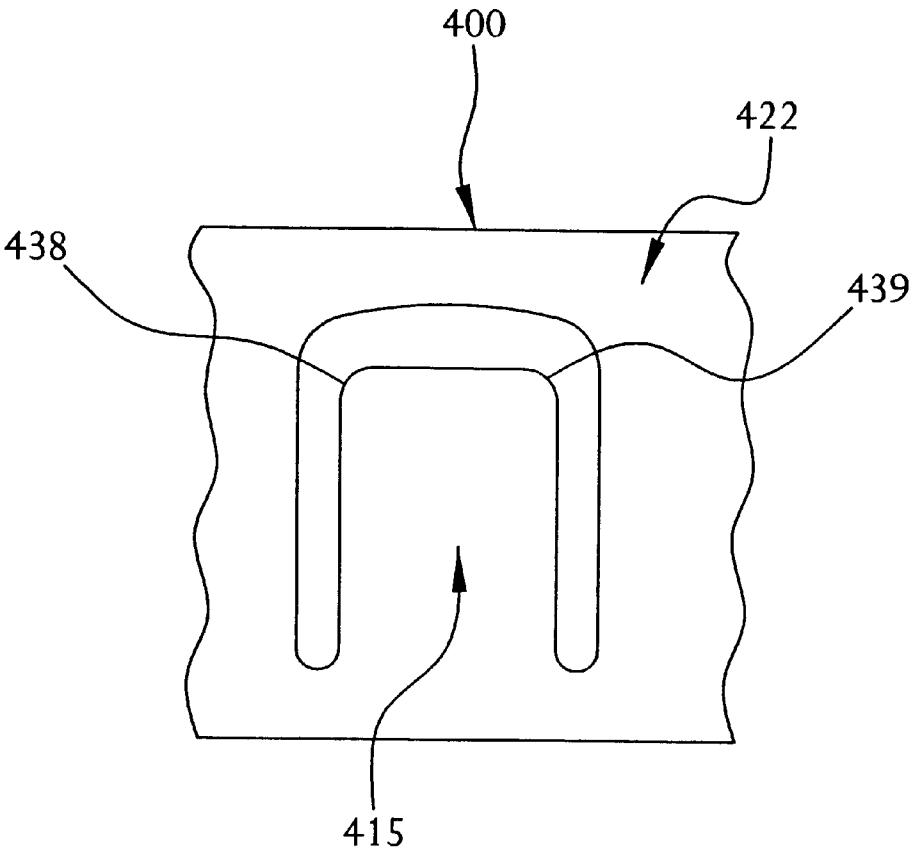
FIG. 20 is a rear elevation fragmentary view of a portion of the latch body and snap leg of the fourth embodiment shown in FIGS. 18 and 19, and taken from the dashed line window 20 FIG. 18.

Referring now to FIGS. 18–20, a fourth alternate embodiment of a pawl latch 400 according to the present invention is shown. The pawl latch 400 is similar to the pawl latches 10, 150 and 300, described herein, but is provided with alternate mounting means. The mounting means is shown in FIG. 18, comprising snap legs 415, 416 (there being identical snap legs on the opposite side of the latch not shown) which facilitate mounting of the latch 400 to a panel, such as a closure panel 100 shown and described in connection with the first embodiment of FIGS. 1–9 and the closure panel 103 shown and described in connection with the third embodiment of FIGS. 13–17. The snap leg members 415, 416, preferably, are provided to comprise spring leg members. Since the spring leg members 415, 416 can be identically provided, only one spring member 415 will be described herein. The snap leg 415 includes a free portion 420 and an attached portion 421. The attached portion 421 is shown connected to a circumferential wall portion 422, extending downwardly from the base 424 of the gripping portion 412 of the latch 400. The free portion 420 of the leg member 415 has a foot 425 with a sloped lower wall 426, a sloped upper wall 427, and a shelf or flat wall 428, which engages the underside of a closure panel, such as those 100, 103 described above. Means for facilitating rotation of the latch where uninstalled in a closure panel is provided. The means for facilitating rotation are shown in FIGS. 18–20, comprising gliding means, such as the rounded edge portions 438, 439, disposed on each lateral side of the shelf or flat wall portion 428. The rounded edge portions 438, 439, are the leading edges of the snap leg member 415, when the latch 400 is rotated. The leg member 416 is also shown with rounded edge portions 436, 437. Referring to FIG. 20, the rear of the snap leg 415 shows the rounded edge portions 438, 439.

Figure 21:
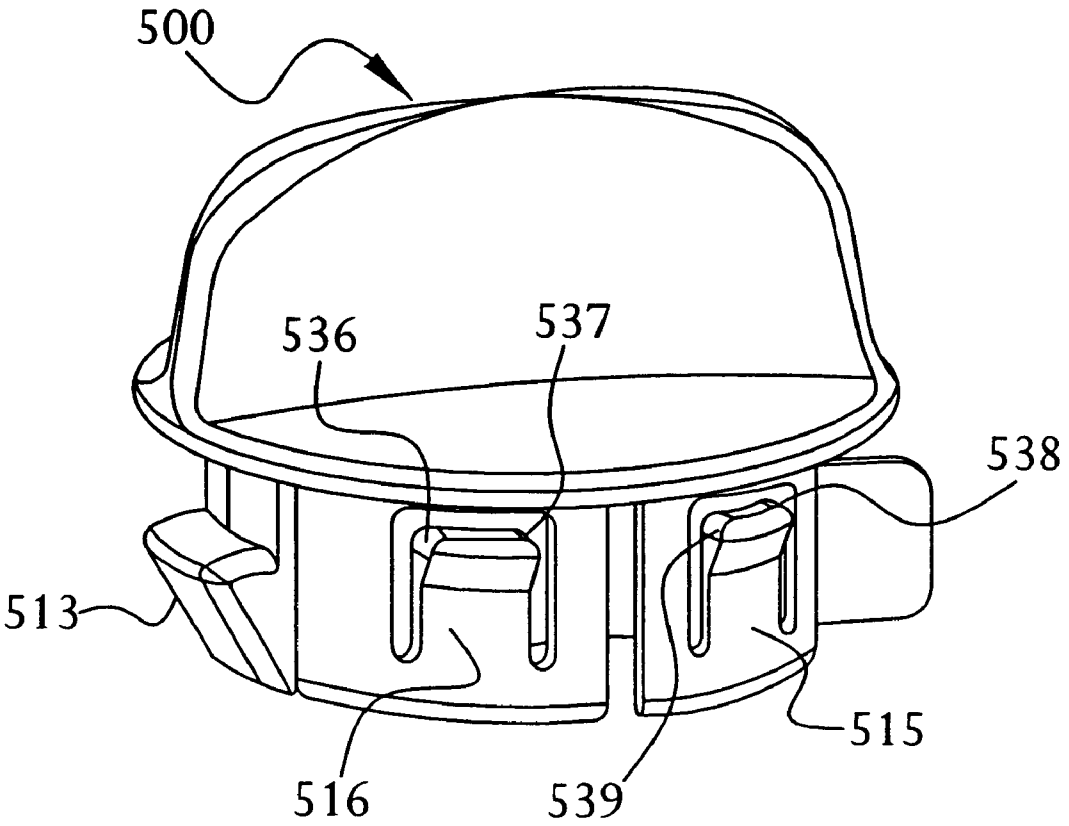
FIG. 21 is a parallel perspective view, as viewed from the top left side, showing a fifth alternate embodiment of a pawl latch according to the present invention.

While the above description constitutes the preferred embodiment of the present invention, it will be appreciated that the invention is subject to modification, variation and change, without departing from the proper scope or fair meaning of the present invention. In this regard, while the various features of the present invention have been shown and described in relation to a door and which operates with a frame, it will be understood that many of these features are suitable in connection with latching of other members. Although the snap leg members shown in the fourth alternate embodiment of FIGS. 18–20 are used in connection with a latch 400 having a pawl member with the head configuration described in connection with the third alternate embodiment of FIGS. 13–17, it is understood that the guide means, including the rounded edges, can be provided on the snap leg members 15, 17 and 18, shown and described herein in connection with the first embodiment of FIGS. 1–9. FIG. 21 shows a fifth alternate embodiment of a pawl latch 500 according to the present invention. The pawl latch 500 is similar in all respects to the first embodiment 10 shown in FIGS. 1–9 and described above, with the addition of the guide means provided on the snap leg members 515, 516. The guide means is shown comprising rounded edges 538, 539 and 536, 537, to facilitate rotational movement of the latch when it is turned in a panel aperture for opening and closing to secure a pawl 513 to a keeper member.

Figure 22:
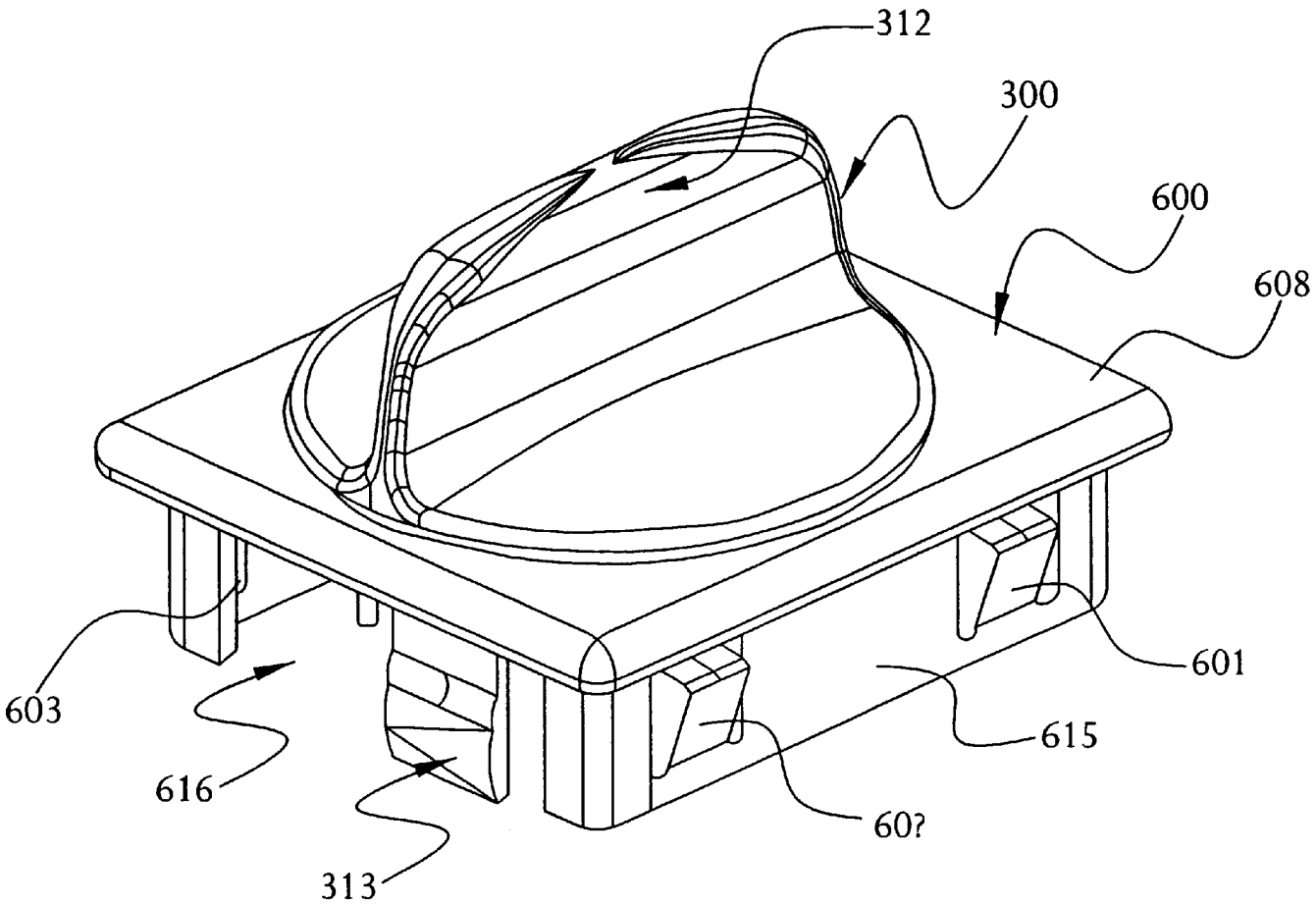
FIG. 22 is a parallel perspective view, as viewed from the front left side, showing the pawl latch of FIGS. 13–17, provided with a bezel for installation to a panel.
Figure 23:
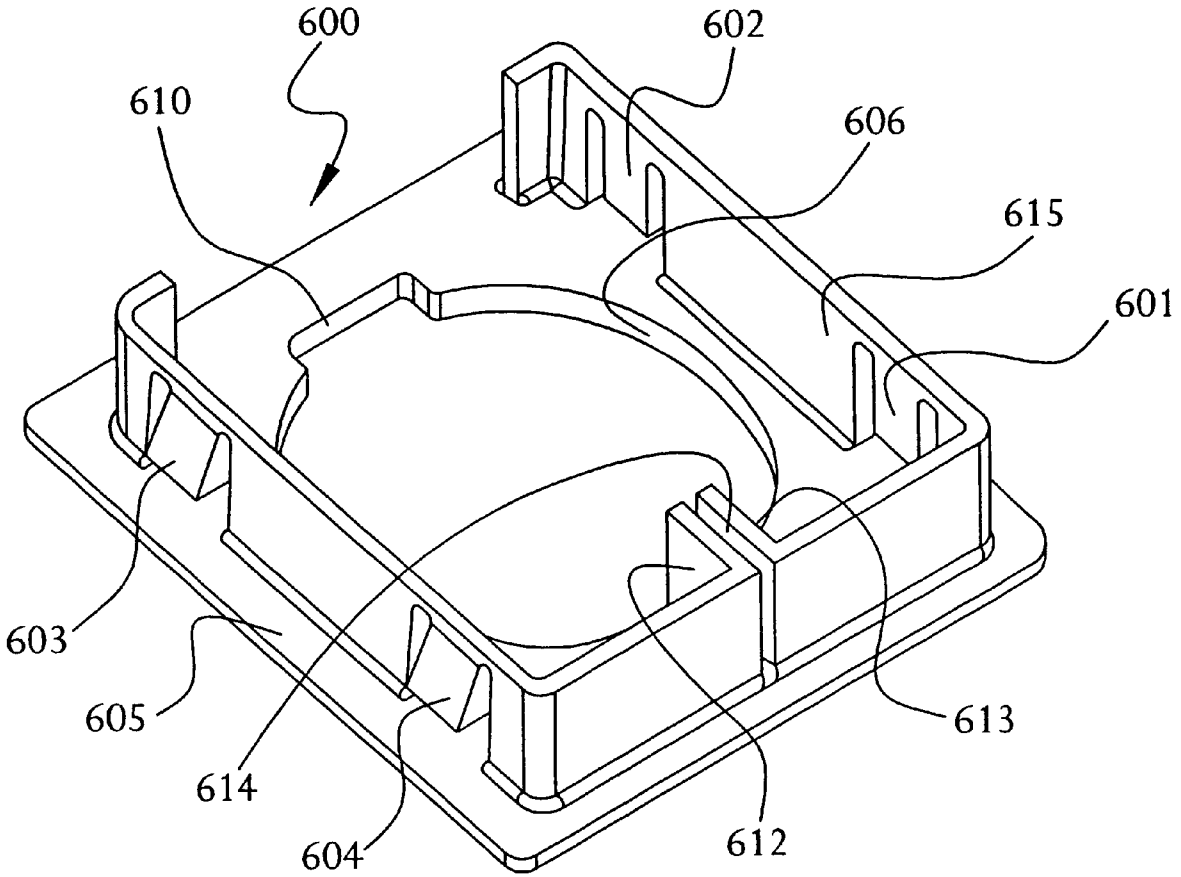
FIG. 23 is a bottom perspective view, as viewed from the rear right side, showing the bezel of FIG. 22 in a separate view.

Referring to FIGS. 22 and 23, a bezel 600 is shown for use in connection with the pawl latch embodiments described herein. The bezel 600 is provided with mounting means, preferably, shown comprising a plurality of mounting elements 601, 602, 603, 604, provided in a particularly preferred embodiment comprising snap leg members being attached to a lower wall portion 615 at one end thereof and having a free end for clamping a panel (not shown) between said each mounting element 601, 602, 603, 604 and the upper flange 605 of the bezel 600 to mount the bezel 600 to a panel. The bezel further includes an aperture 606 disposed in the top surface 608 of the bezel 600. The aperture 606 includes an enlarged portion 610 provided at the front of the bezel 600. This enlarged portion 610 facilitates insertion of the pawl 313 through the bezel 600 when the latch, such as that 300, shown in FIG. 22, is inserted into the aperture 606.

Holding means for holding the spring member 314 of the latch 300 is also provided. The holding means is shown comprising a pair of walls 612, 613 which are spaced apart from each other to define a slot 614 therebetween for accommodating the end 332 of the spring member 314 of the latch 300. Preferably, as shown in FIGS. 22 and 23, the walls 612, 613 and the mounting elements 601, 602, 603 and 604 preferably are provided on a lower wall portion 615 extending downwardly from the top surface 608 of the bezel 600. As shown in FIG. 22, the lower wall 615 preferably is open in the front of the bezel 600 to provide a space 616 to allow the pawl 313 to access a corresponding keeper member or panel surface (not shown).

While shown and described in connection with the latch embodiment 300, it will be understood that the bezel 600 can accommodate alternate latch embodiments as described herein and consistent with the scope of the invention. The bezel 600 is particularly useful in situations where an uneven surface is provided which might otherwise disrupt the smooth operation of the pawl latch. The bezel 600 offers the ability to mount onto a panel, such as a carpeted panel or coarse surfaced panel, while at the same time providing an area of uniform smoothness for the latch to rotate about.

These and other advantages of the present invention can be made consistent with the spirit and scope of the invention as disclosed in the Summary of the Invention, the Brief Description of the Drawing Figures, the Detailed Description of the Preferred Embodiments and the appended Claims.

What is claimed is:

1. A one piece pawl latch adapted for mounting in an aperture formed in a closure panel for releasably retaining the closure panel against a corresponding frame, wherein the pawl engages with the frame or a keeper member provided on the frame to maintain the closure panel and frame in a secured relation, the pawl latch comprising:

a) a latch body adapted for being received within an aperture of a closure panel and having mounting means for securing said latch body to a closure panel;

b) biasing means provided on said latch body for providing rotational resistance to the pawl latch upon rotational movement thereof from a first position to a second position to return the pawl latch to its first position;

c) a pawl member having an engaging end for engaging with a frame or keeper member, said pawl member being connected to said latch body and being deflectable away from said frame member; and d) wherein the latch body further includes gripping means for facilitating actuation of said latch.

2. The pawl latch of claim 1, further comprising a keeper for stopping the closure panel at a predetermined position relative to said frame and for engaging said pawl member for connection thereto.

3. The pawl latch of claim 1, wherein said gripping means comprises a gripping portion and a base portion connected thereto.

4. The pawl latch of claim 3, wherein said mounting means comprises a plurality of flexible snap leg members provided on said latch body, said flexible snap leg members each having an engaging foot for clamping said closure panel between said engaging foot and said base portion of said gripping means.

5. The pawl latch of claim 1, wherein said biasing means comprises a spring member having a first end connected to said latch body and having a second end which is deflectable in relation to said latch body.

6. The pawl latch of claim 5, wherein said pawl latch further comprises holding means adapted for connection to a closure panel for holding said second end of said spring member.

7. The pawl latch of claim 6, wherein said holding means comprises a pair of bosses adapted to extend from said closure panel and being separated from each other to define a space therebetween, and wherein said spring second end extends through said space between said bosses, wherein said spring second end engages at least one of said bosses when the latch is rotated.

8. A one piece pawl latch adapted for mounting in an aperture formed in a closure panel for releasably retaining the closure panel against a corresponding frame, wherein the pawl engages with the frame or a keeper member provided on the frame to maintain the closure panel and frame in a secured relation, the pawl latch comprising:

a) a latch body adapted for being received within an aperture of a closure panel and having mounting means for securing said latch body to a closure panel;

b) a pawl member having an engaging end for engaging with a frame or keeper member, said pawl member being connected to said latch body and being deflectable away from said frame member;

c) gripping means for facilitating actuation of said latch, said gripping means comprising a gripping portion and a base portion connected thereto;

d) wherein said latch body includes a plurality of circumferentially spaced apart wall portions, each wall portion having a free end and a connected end, said connected end being connected to the base portion of said gripping means;

e) biasing means provided on said latch body for providing rotational resistance to the pawl latch upon rotational movement thereof from a first position to a second position to return the pawl latch to its first position; and f) holding means adapted to be provided on said closure panel for holding said biasing means.

9. The pawl latch of claim 8, further comprising a keeper for stopping the closure panel at a predetermined position relative to said frame.

10. The pawl latch of claim 8, wherein said gripping means comprises a gripping portion and a base portion connected thereto, wherein the gripping portion includes indented sidewalls for facilitating gripping of the latch by a user.

11. The pawl latch of claim 8, wherein said mounting means comprises a plurality of flexible leg members provided on said latch body, said flexible leg members each having an engaging foot for clamping said closure panel between said engaging foot and said base portion of said gripping means.

12. The pawl latch of claim 8, wherein said biasing means comprises a spring member having a first end connected to said latch body and having a second end which is deflectable in relation to said latch body.

13. The pawl latch of claim 12, wherein said holding means comprises an element which holds said spring second end when the latch is rotated.

14. A pawl latch adapted for mounting in an aperture formed in a closure panel for releasably retaining the closure panel against a corresponding frame, wherein the pawl engages with the frame or a keeper member provided on the frame to maintain the closure panel and frame in a secured relation, the pawl latch comprising:

a) a latch body adapted for being received within an aperture of a closure panel and having mounting means for securing said latch body to a closure panel;

b) a pawl member having an engaging end for engaging with a frame or keeper member, said pawl member being connected to said latch body and being deflectable away from said frame member;

c) wherein said latch body includes gripping means for facilitating actuation of said latch, said gripping means comprising a gripping portion and a base portion connected thereto;

d) wherein said latch body includes a plurality of circumferentially spaced apart wall portions, each wall portion having a free end and a connected end, said connected end being connected to the base portion of said gripping means;

e) biasing means provided on said latch body for providing rotational resistance to the pawl latch upon rotational movement thereof from a first position to a second position to return the pawl latch to its first position, said biasing means comprising a spring member having a first end connected to said latch body and having a second end which is deflectable relative to said latch body;

f) holding means adapted to be provided on said closure panel for holding said biasing means, said holding means comprising an element which holds said spring second end when the latch is rotated;

g) keeper means for stopping the closure panel at a predetermined position relative to said frame;

h) wherein said mounting means comprises a plurality of flexible leg members provided on said latch body, said flexible leg members each having an engaging foot for clamping said closure panel between said engaging foot and said base portion of said gripping means; and i) wherein said latching body is rotated to release the pawl from an engaging relationship with a keeper.

15. The pawl latch of claim 1, wherein said pawl engaging end has a head thereon for engagement with a keeper member.

16. The pawl latch of claim 15, wherein said pawl member head includes at least a pair of tapering sidewall portions which converge to form a nose.

17. The pawl latch of claim 16, further including a tapering lower wall portion, which converges with said tapering sidewall portions.

18. The pawl latch of claim 17, wherein said sidewall portions and said bottom wall portion are generally triangular in shape, and wherein said triangular shaped sidewall portions and bottom wall portion converge to form a head having a generally pyramidal configuration.

19. The pawl latch of claim 4, wherein said snap legs further include means for facilitating rotation of said latch when the latch is installed in a panel aperture.

20. The pawl latch of claim 4, wherein said engaging foot has a sloped lower wall and a sloped upper wall with a top wall portion thereon, wherein said top wall portion has a front edge and a rear edge and a pair of side edges, and wherein said side edges are rounded edges.

21. The pawl latch of claim 11, wherein said engaging foot has a sloped lower wall and a sloped upper wall with a top wall portion thereon, wherein said top wall portion has a front edge and a rear edge and a pair of side edges, and wherein said side edges are rounded edges.

22. The pawl latch of claim 16, wherein said snap legs further include means for facilitating rotation of said latch when the latch is installed in a panel aperture.

23. The pawl latch of claim 1, further comprising a bezel for facilitating mounting of said pawl latch to a closure panel.

24. The pawl latch of claim 23, wherein said bezel has an aperture disposed therein for facilitating mounting of the pawl latch thereto.

25. The pawl latch of claim 5, further comprising a bezel having mounting means for mounting said bezel to a closure panel, wherein said bezel has holding means for holding said spring member, and wherein said bezel has an aperture for facilitating mounting of said pawl latch to said bezel, wherein said pawl latch is rotatable relative to said bezel, and wherein said bezel is adapted to be fixably mounted to a closure panel.

26. The pawl latch of claim 20, further comprising a bezel for facilitating mounting of said pawl latch to a closure panel.

27. The pawl latch of claim 26, wherein said bezel has an aperture disposed therein for facilitating mounting of the pawl latch thereto.

* * * * *

UNITED STATES PATENT AND TRADEMARK OFFICE

CERTIFICATE OF CORRECTION

PATENT NO. : 6,305,725 B1
DATED : October 23, 2001
INVENTOR(S) : Antonucci et al.

It is certified that error appears in the above-identified patent and that said Letters Patent is hereby corrected as shown below:

Column 3,
Line 42, please insert -- is -- after the "1".
Line 48, please delete "e" and replace with -- the --.

Column 7,
Line 33, please delete "31 1" and replace with -- 311 --.

Signed and Sealed this

Sixteenth Day of April, 2002

*Attest:*

*Attesting Officer*

JAMES E. ROGAN
*Director of the United States Patent and Trademark Office*